US009715980B2

(12) United States Patent
Namikawa

(10) Patent No.: US 9,715,980 B2
(45) Date of Patent: Jul. 25, 2017

(54) BREAKER, SAFETY CIRCUIT PROVIDED WITH SAME, AND SECONDARY CELL

(71) Applicant: KOMATSULITE MFG. CO., LTD., Suita-shi, Osaka (JP)

(72) Inventor: Masashi Namikawa, Suita (JP)

(73) Assignee: KOMATSULITE MFG. CO., LTD., Suita-shi (JP)

( * ) Notice: Subject to any disclaimer, the term of this patent is extended or adjusted under 35 U.S.C. 154(b) by 31 days.

(21) Appl. No.: 14/351,413

(22) PCT Filed: Oct. 12, 2012

(86) PCT No.: PCT/JP2012/076540
§ 371 (c)(1),
(2) Date: Apr. 11, 2014

(87) PCT Pub. No.: WO2013/054927
PCT Pub. Date: Apr. 18, 2013

(65) Prior Publication Data

US 2014/0285308 A1 Sep. 25, 2014

(30) Foreign Application Priority Data

Oct. 14, 2011 (JP) ..... 2011-227389

(51) Int. Cl.
*H01H 37/04* (2006.01)
*H01H 37/54* (2006.01)
*H01H 37/08* (2006.01)

(52) U.S. Cl.
CPC ..... *H01H 37/04* (2013.01); *H01H 37/54* (2013.01); *H01H 37/08* (2013.01); *H01H 37/5409* (2013.01); *H01H 37/5418* (2013.01)

(58) Field of Classification Search
CPC ..... H01H 37/04; H01H 37/08; H01H 37/54; H01H 37/5409; H01H 37/5418
(Continued)

(56) References Cited

U.S. PATENT DOCUMENTS 5,145,057 A * 9/1992 Hirota ..... H01H 50/545 200/16 A
5,607,610 A * 3/1997 Furukawa ..... H01H 1/504 219/488
(Continued)

FOREIGN PATENT DOCUMENTS

EP 2 541 576 A1 1/2013
JP 7-125021 A 5/1995
(Continued)

OTHER PUBLICATIONS

Yagi (WO 2011105175), Machine Translation.*
Shibuya, JP2005203277, EPO machine translation.*
International Search Report issued in PCT/JP2012/076540 mailed Dec. 4, 2012.

*Primary Examiner* — Anatoly Vortman
*Assistant Examiner* — Jacob Crum
(74) *Attorney, Agent, or Firm* — Birch, Stewart, Kolasch & Birch, LLP

(57) ABSTRACT

A breaker (1) is provided with: a fixed piece (2) which has a fixed contact; a movable piece which has a movable contact at a front end portion and pushes the movable contact against the fixed contact to bring same into contact with each other; a thermally responsive element that deforms in accordance with a change in temperature and thereby actuates the movable piece so that the movable contact separates from the fixed contact; and a case body (71) of a resin case that accommodates the fixed piece (2), the movable piece, and the thermally responsive element. The case body (71) has recess portions (75, 77) which are recessed from a peripheral portion, and the fixed piece (2) has a withdrawal portion (25) that withdraws from the recess portions (75, 77) of the case body (71) by a predetermined first distance (D1) or more, and is embedded in the case body (71).

15 Claims, 8 Drawing Sheets

(58) Field of Classification Search
USPC ..... 337/100, 112, 113
See application file for complete search history.

(56) References Cited

U.S. PATENT DOCUMENTS

| | | | | |
|---|---|---|---|---|
| 5,936,510 | A * | 8/1999 | Wehl | H01H 37/5418 337/100 |
| 6,300,860 | B1 * | 10/2001 | Hofsass | H01H 1/504 337/100 |
| 6,396,381 | B1 * | 5/2002 | Takeda | H01H 1/504 337/342 |
| 2002/0060898 | A1 * | 5/2002 | Nagai | H01H 37/54 361/634 |
| 2007/0269997 | A1 * | 11/2007 | Eldridge | G01R 1/0483 439/66 |
| 2011/0035763 | A1 * | 2/2011 | Nakanishi | G11B 17/0282 720/695 |
| 2011/0168919 | A1 * | 7/2011 | Yoder | G01T 3/00 250/483.1 |

FOREIGN PATENT DOCUMENTS

| | | | |
|---|---|---|---|
| JP | 2005-174816 | A | 6/2005 |
| JP | 2005-203277 | A | 7/2005 |
| JP | 2006-31956 | A | 2/2006 |
| JP | 2007-36026 | A | 2/2007 |
| WO | WO 2011/105175 | A1 | 9/2011 |

* cited by examiner

BREAKER, SAFETY CIRCUIT PROVIDED WITH SAME, AND SECONDARY CELL

TECHNICAL FIELD

The present invention relates to a miniaturized breaker or the like that is incorporated in a secondary battery and the like of electrical machines.

BACKGROUND ART

Conventionally, breakers have heretofore been used as protecting devices for a secondary battery, a motor, and the like of various kinds of electrical machines. When a temperature of the secondary battery increases in excess during charging and discharging, or when abnormality occurs such as a case where excessive current flows through motors mounted in machines such as automotive vehicles and home electric appliances, the breaker shuts down electric current for protecting the secondary battery, the motors, and the like. To reliably ensure safety for machines, the breaker, which is used as such a protecting device, is required to precisely operate conjunction with a change in temperature.

Further, the breaker is likely to be used as the protecting device for the secondary battery and the like equipped in electrical machines such as a notebook personal computer, a tablet portable terminal device, and a compact multi-functional mobile phone called a smart phone. In such likelihood, in addition to enhanced safety mentioned above, the breaker is required to be miniaturized. In particular, there is a strong inclination for down-sized (thinner) portable information terminals on the part of users, and machines newly released by manufacturers have a remarkable tendency to be designed in miniaturization for enhanced superiority in design. Under such a background, there is a strong demand for further miniaturization of the breaker, which is mounted with the secondary battery as one component part of the portable information terminal device.

The breaker includes a thermally responsive element operating depending on a change in temperature for conducting or shutting off the flow of current. Patent document 1 discloses a breaker to which bimetal is applied as a thermally responsive element. Bimetal is an element composed of a stack of plate-shaped metallic materials of two kinds with different thermal expansion rates, which alters in shape depending on a change in temperature for controlling a conducting state of contacts. The breaker disclosed in the same document has component parts, such as a fixed piece (base terminal), a movable piece (movable arm), a thermally responsive element, and a PTC thermistor. These parts are accommodated in a resin case with terminals of the fixed piece and the movable piece being connected to an electric circuit of electrical machines in use.

Patent document 1: WO2011/105175.

SUMMARY OF THE INVENTION

Problems to be Solved by the Invention

FIG. 9 shows one example of a bottom surface of a related art breaker disclosed in patent document 1. With a view to promoting the miniaturization (low profile), a breaker 100 has a structure in which a fixed piece 2, which is insert-molded, has a front end portion 23 and an associated neighboring partial area exposed from a bottom surface of a resin case 7.

A resin material to be formed into the resin case 7 is supplied through a gate of a molding die provided in an area that forms the bottom surface of the resin case 7. Resin hardened in the gate is cut out during demolding or in subsequent treatment such that the bottom surface of the resin case 7 has a partial area left as a gate cut mark 76.

As the gate cut mark 76 protrudes from the bottom surface of the resin case 7, it is likely for troubles to occur when the breaker 100 is installed onto the secondary battery or the like. As shown in FIG. 9, therefore, the breaker 100 takes the application of a structure in which a recessed portion 75 is formed on the bottom surface of the resin case 7 such that the recessed portion 75 accommodates the gate cut mark 76 with no gate cut mark 76 protruding from the bottom surface of the resin case 7.

Further, it is likely for the bottom surface of the resin case 7 to have a engraved mark 78 indicating a part number and a production lot number of the breaker 100, similarly to the gate cut mark 76 mentioned above, a structure has been proposed for the engraved mark 78 to be accommodated in a recessed portion 77, which is formed on the bottom surface of the resin case 7. In the structure, the engraved mark 78 does not protrude from the bottom surface of the resin case 7.

However, if an end edge of the fixed piece 2, which is exposed at the bottom surface of the resin case 7, becomes closer in distance (that is, in a distance between a protruding portion provided on a wall defining a cavity space of the molding die for forming the resin case, and the fixed piece 2) to side walls of the recessed portions 75, 77, a failure occurs when the resin material is filled into the cavity space of the molding die. That is, the flow of the resin material is locally blocked with the occurrence of filling defect. Further, the resin case 7 has a localized area with an insufficient wall thickness, causing a risk to occur with deterioration of strength of the resin case 7. Likewise, when a portion of the movable piece 4 and the recessed portions 75, 77 become excessively closer in distance, there are risks of causing the occurrence of filling defect of the resin material and deterioration of strength of the resin case 7.

To minimize such filling defect of the resin material, the present inventor has studied a layout for the fixed piece 2, the movable piece 4, and the recessed portions 75, 77 to be spaced from each other by equal to or longer than a preset distance. However, such a placement brings about the enlargement of the resin case 7, resulting in a cause of preventing the miniaturization of the breaker.

The present invention has been made in view of the above-described circumstances, and it is an object of the present invention to provide a breaker that can realize miniaturization without causing the filling defect of the resin material and deterioration of strength of the resin case.

Means of Solving the Problems

To achieve the above object, the present invention provides a breaker including: a fixed piece having a fixed contact; a movable piece having a movable contact at a front end portion and configured to cause the movable contact to be held in pressured contact with the fixed contact; a thermally responsive element configured to actuate the movable piece upon deformation in response to a change in temperature such that the movable contact is separated away from the fixed contact; and a resin case accommodating the fixed piece, the movable piece, and the thermally responsive element. The resin case includes a recessed portion depressed from a peripheral portion. The fixed piece includes a withdrawal portion withdrawing from the recessed portion of the resin case and embedded in the resin case.

With the breaker according to the present invention, the fixed piece is provided with the withdrawal portion to allow the fixed piece embedded in the resin case to withdraw from the withdrawal portion of the resin case. This increases the degree of freedom in position, shape, and size of the recessed portion without causing the filling defect of the resin material between the fixed piece and the recessed portion and deterioration of strength of the resin case. This realizes the miniaturization of the breaker.

MODE FOR CARRYING OUT THE INVENTION

Figure 1:
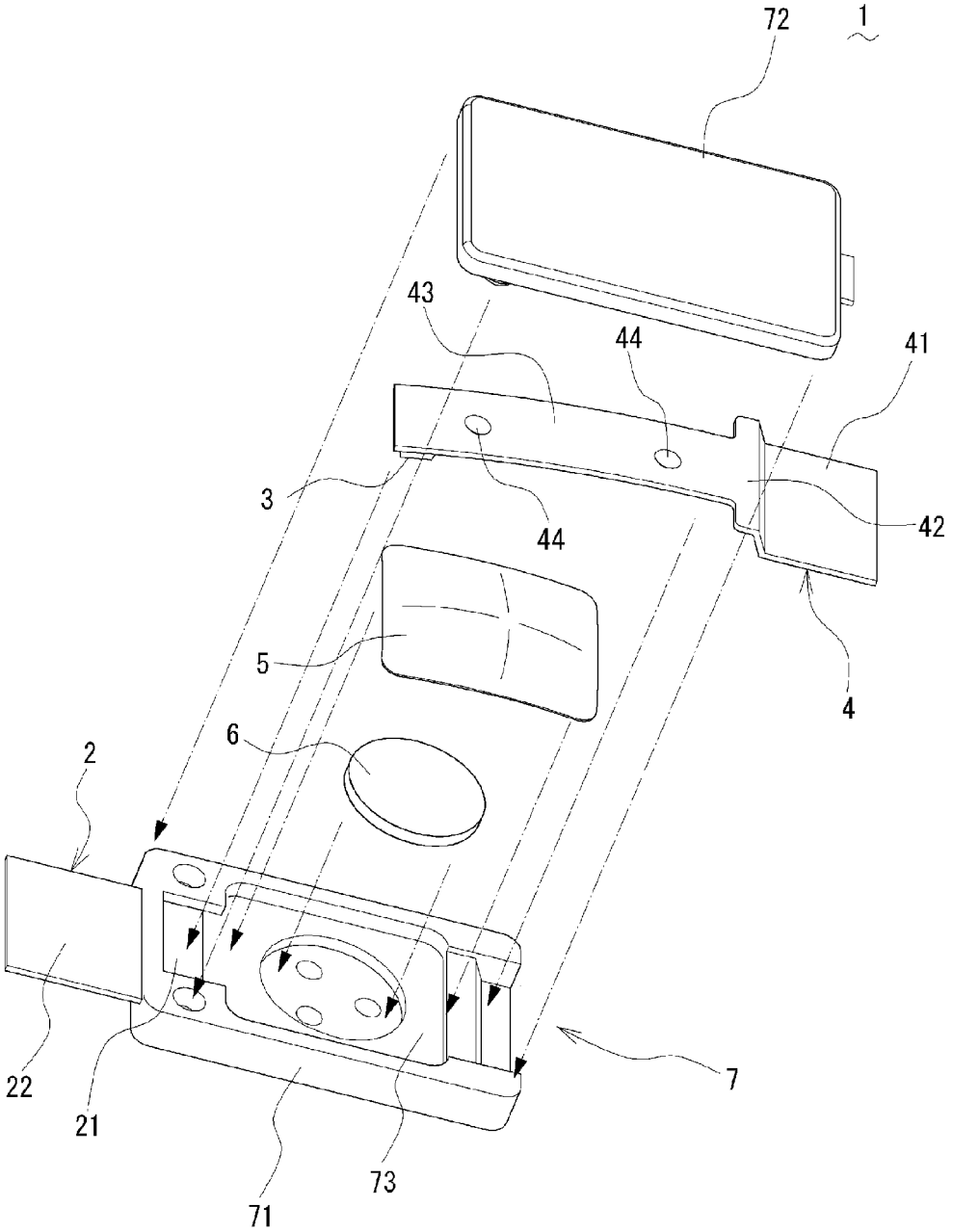
FIG. 1 is an assembling perspective view showing a structure of a breaker of one embodiment according to the present invention.
Figure 2:
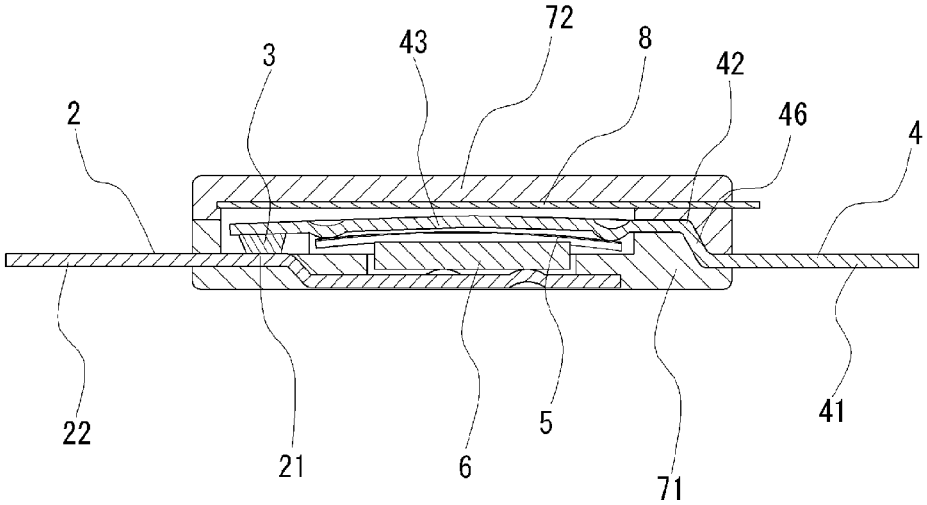
FIG. 2 is a cross-sectional view showing how the breaker operates in a normal charging or discharging state.
Figure 3:
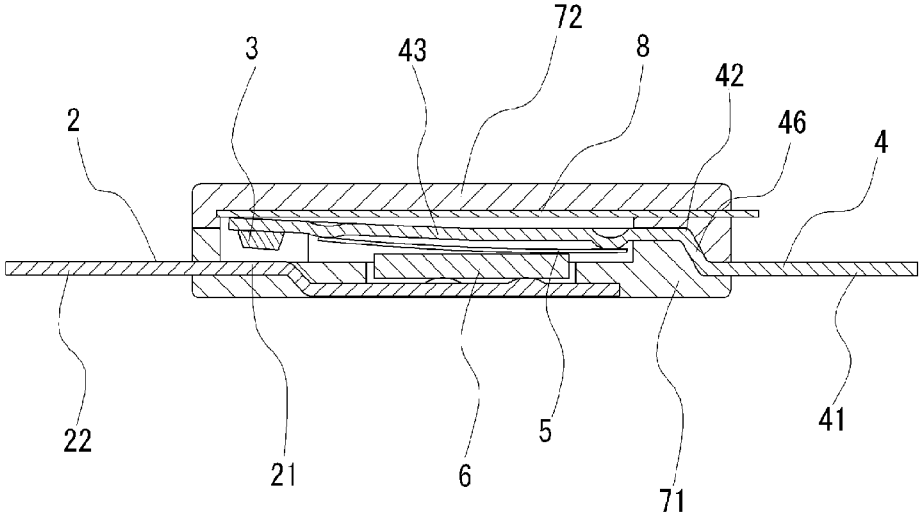
FIG. 3 is a cross-sectional view showing how the breaker operates in an excessively charged state or in an abnormal state.

A breaker of one embodiment according to the present invention will be described below with reference to the accompanying drawings. FIGS. 1 to 3 show a structure of the breaker. The breaker 1 includes: a fixed piece 2 having a fixed contact 21; a movable piece 4 having a movable contact 3 at a front end portion; a thermally responsive element 5 that deforms in accordance with a change in temperature; a PTC (Positive Temperature coefficient) thermistor 6; and a resin case 7 accommodating the fixed piece 2, the movable piece 4, the thermally responsive element 6, and the PTC thermistor 6. The resin case 7 includes a case body 71, and a lid member 72 mounted on the case body 71 at an upper surface thereof.

The fixed piece 2 is made of a metallic plate mainly made of, for example, phosphor bronze (other examples including a metallic plate made of copper-titanium alloy, nickel silver, or brass). The metallic plate is press formed and embedded in the case body 71 by insert forming. The fixed piece 22 has one end provided with a terminal 22 to be electrically connected to an external part and the other end 23 having a peripheral area on which the PTC thermistor 6 located. The PTC thermistor 6 is placed on convex-shaped joggles (small protrusions) 24 (see FIG. 5), which are formed on the peripheral area of the other end 23 of the fixed piece 2 at three positions. The fixed contact 21 is formed in a position opposite to the movable contact 3 by, for example, cladding, plating, or coating of a highly conductive material such as silver and a nickel-silver alloy; other examples include a copper-silver alloy and a gold-silver alloy. The fixed contact 21 is exposed in part from an opening 73 formed in the case body 71 at an upper area thereof. The terminal 22 protrudes outward from one end of the case body 71.

The movable piece 4 is formed in an arm shape by press forming a metallic plate similar to that of the fixed piece 2. The movable piece 4 has a longitudinal one end provided with a terminal 41 to be electrically connected to an external part, and protrudes outward from the case body 71. With the present embodiment, to align the terminal 22 of the fixed piece 2 and the terminal 41 of the movable piece 4 with each other in height, the movable piece 4 is bent in a crank-shape at a stepped bent portion 46 in an area within an inner part of the resin case 7. The movable piece 4 has the other end (correspond to a front end of the arm-shaped movable piece 4) provided with a movable contact 3. The movable contact 3 is made of a material similar to that of the fixed contact 21, and is jointed to a front end of the movable piece 4 by a technique such as welding. The movable piece 4 has a stationary portion 42 (corresponds to a base end of the arm-shaped movable piece 4) and a resilient portion 43, which are formed between the movable contact 3 and the terminal 41. The stationary portion 42 is sandwiched between the case body 71 and the lid member 72 to fixedly retain the movable piece 4. Permitting the resilient portion 43 to resiliently deform causes the movable contact 3, which is formed at the front end of the resilient portion, to be pressed against and brought into contact with the fixed contact 21, thereby enabling the fixed piece 2 and the movable piece 4 to be electrically connected with each other.

Further, the resilient portion 43 has a lower surface provided with a pair of small projections formed facing to the thermally responsive element 5. The small projections 44 and the thermally responsive element 5 are held in contact with each other, causing the deformation of the thermally responsive element 5 to be transferred to the resilient portion 43 via the small projections 44 (see FIGS. 2 and 3). Examples of materials of the movable piece 4 may preferably include those mainly made of phosphor bronze. In addition, electrically connected resilient materials may be used including a copper-titanium alloy, nickel silver, and brass. Also, the movable piece 4 is subjected to press forming at the resilient portion 43 to be curved or bent in shape. The degree of curving or bending is not particularly limited insofar as the thermally responsive element 5 is accommodated and may be suitably set in consideration of, for example, a resilient force at an actuating temperature and restoring temperature and a pressing force of the contact.

The thermally responsive element 5 has an initial shape that is curved in a circular arc, and is made of composite materials such as bimetal and trimetal when overheating takes place to reach an actuating temperature, the curved shape is warped in an opposite direction with the occurrence of a snap motion. Whereas, when the temperature exceeds below a restoring temperature due to a cooling effect, the curved shape is restored. The initial shape of the thermally responsive element 5 can be formed by press working. The material and the shape of the thermally responsive element 5 are not particularly limited insofar as the thermally responsive element 5 is subject to a reverse warping motion at an initial temperature to cause the resilient portion 43 of the movable piece 4 to move upward while the resilient portion 43 is restored due to its resilient force. However, the thermally responsive element 5 may be preferably formed in a rectangular shape in view of productivity and efficiency of the reverse warping motion, and a rectangular shape may be preferably formed in an oblong shape closer to a square shape in order for the resilient portion 43, even in a miniaturized shape, to be efficiently moved upward. Examples of the material constituting the thermally responsive element 5 include a stack of two kinds of materials with different thermal expansion coefficients such as various alloys of nickel silver, brass, and stainless steel, and the like. For example, a copper-nickel-manganese alloy or a nickel-chrome-iron alloy may be placed on the high expansion side, while an iron-nickel alloy may be placed on the low expansion side. The combination of the alloys may be set depending on required conditions.

When the current between the fixed piece 2 and the movable piece 4 is shut off due to the reverse warping motion of the thermally responsive element 5, the current flowing through the PTC thermistor 6 increases. Kinds of the PTC thermistor 6 may be selected depending on needs such as operating current, operating voltage, operating temperature, and a restoring temperature, provided that the PTC thermistor 6 includes a positive characteristic thermistor configured to limit the current with resistance value increasing with a temperature rise. The PTC thermistor 6 may have a shape that is not particularly limited unless various characteristics are sacrificed.

The case body 71 and the lid member 72, which constitute the resin case 7, are formed of resins such as flame retardant polyamide, polyphenylene sulfide (PPS) having excellent heat resistance, liquid crystal polymer (LCP), and polybutylene terephthalate (PBT). The case body 71 is opened to define an accommodating portion 73 for accommodating the fixed piece 2, the movable piece 4, the thermally responsive element 5, the PTC thermistor 6, and other elements. Moreover, the accommodating portion 73 of the case body 71 is internally provided with frames 73*a*, 73*b*, 73*c* and 73*d* to be held in abutting engagement with end edges of the movable piece 4, the thermally responsive element 5, and the PTC thermistor 6. The case body 71 is formed in a stepwise pattern with the respective frames 73*a*, 73*b*, 73*c* and 73*d* at inner and outer sides thereof. Moreover, the fixed piece 2 and the case body 71 are formed in a stepwise pattern at the inside and the outside of the frame 73. The movable piece 4, the thermally responsive element 5, and the PTC thermistor 6 are brought into abutting engagement with and guided by the frames 73*a*, 73*b*, 73*c* and 73*d*, respectively, during the step of assembly to the case body 71. Furthermore, the end edges of the movable piece 4 and the thermally responsive element 5 assembled to the case body 71 are brought into abutting engagement with the frames 73*a*, 73*b* and 73*c*, and guided by the frames 73*a*, 73*b* and 73*c* during reverse warping motion of the thermally responsive element 5. Also, the end edges of the PTC thermistor 6 have sidewalls which are brought into abutting engagement with the frame 73*d* formed on the side wall in opposed relation such that the PTC thermistor 6 is positioned in place.

A cover piece 8 is embedded in the lid member 72 by insert forming. The cover piece 8, made of a metallic plate mainly made of phosphor bronze or a metallic plate such as stainless steel or the like, is formed by press work. As shown in FIGS. 2 and 3, the cover piece 8 is suitably held in abutting contact with an upper surface of the movable piece 4 to restrict the movement of the movable piece 4, while enhancing the rigidity and strength of the lid member 72, that is, the resin case 7 serving as a housing.

As shown in FIG. 1, the lid member 72 is mounted on an upper surface of the case body 71 so as to cover the opening 73 of the case body 71 accommodating the fixed piece 2, the movable piece 4, the thermally responsive element 5, and the PTC thermistor 6. The case body 71 and the lid member 72 are jointed together by, for example, ultrasonic welding.

FIG. 2 shows how the breaker 1 operates in normal charging and discharging states. In the normal charging and discharging states, the thermally responsive element 5 remains in the initial state (prior to the reverse warping motion), in which the fixed contact 21 and the movable contact 3 are held in contact with each other, thereby providing electrical connection between the both terminals 22 and 41 of the breaker 1 via the resilient portion 43 of the movable piece 4. The resilient portion 43 of the movable piece 4 and the thermally responsive element 5 are held in contact with each other, and the movable piece 4, the thermally responsive element 5, the PTC thermistor 6, and the fixed piece 2 form circuits to be electrically conducted with each other. However, since the PTC thermistor 6 has overwhelmingly larger resistance than that of the movable piece 4, an electric current flows through the PTC thermistor 6 to a negligible extent as compared with those flowing through the fixed contact 21 and the movable contact 3.

FIG. 3 shows how the breaker 1 operates in an overcharge state or in a failure. When a high temperature status is present due to the overcharge state or the failure, the PTC thermistor 6 overheats and the thermally responsive element 5 reaches an actuating temperature. This causes the thermally responsive element 5 to warp in an opposite direction and the resilient portion 43 of the movable piece 4 to move upward, resulting in the fixed contact 21 and the movable contact 3 being disengaged from each other. This interrupts the flow of electric current between the fixed contact 21 and the movable contact 3, resulting in a slight amount of leak current flowing through the thermally responsive element 5 and the PTC thermistor 6. The PTC thermistor 6 continues to generate heat insofar as such a leak current is present, causing the thermally responsive element 5 to be maintained in the reverse warping status with a remarkable increase in resistance value. Thus, no electric current flows through the path between the fixed contact 21 and the movable contact 3 with only a slight amount of leak current being present (forming a self-holding circuit). This leak current may be allocated for other functions of the safety device.

When the overcharging status is released or when the failure is addressed, the heat generation of the PTC thermistor 6 is stopped, causing the thermally responsive element 5 to return to the restoring temperature for restoring the original initial shape. In addition, due to the resilient force of the resilient portion 43 of the movable piece 4, the movable contact 3 and the fixed contact 21 are brought into contact with each other again. This releases the shutoff state of the circuit to restore the conducting state as shown in FIG. 2.

Figure 4:
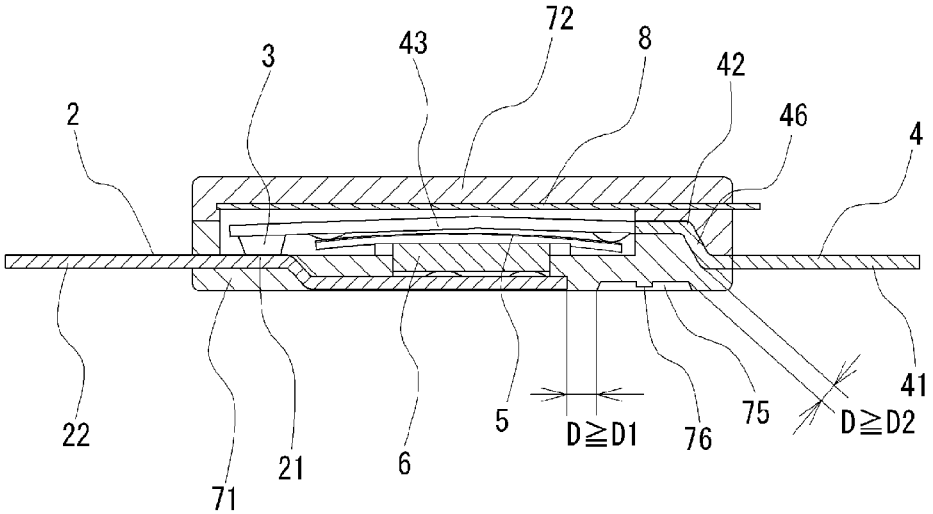
FIG. 4 is another cross-sectional view of the breaker remained in the normal charging or discharging state.

FIG. 4 shows another cross-section of the breaker 1 in the normal charging state or the discharging state. The bottom surface of the case body 71 of the resin case 7 of the breaker 1 has a recessed portion 75 (see FIG. 5 described later). FIG. 4 represents a cross-sectional view with the recessed portion 75 being involved.

Figure 5:
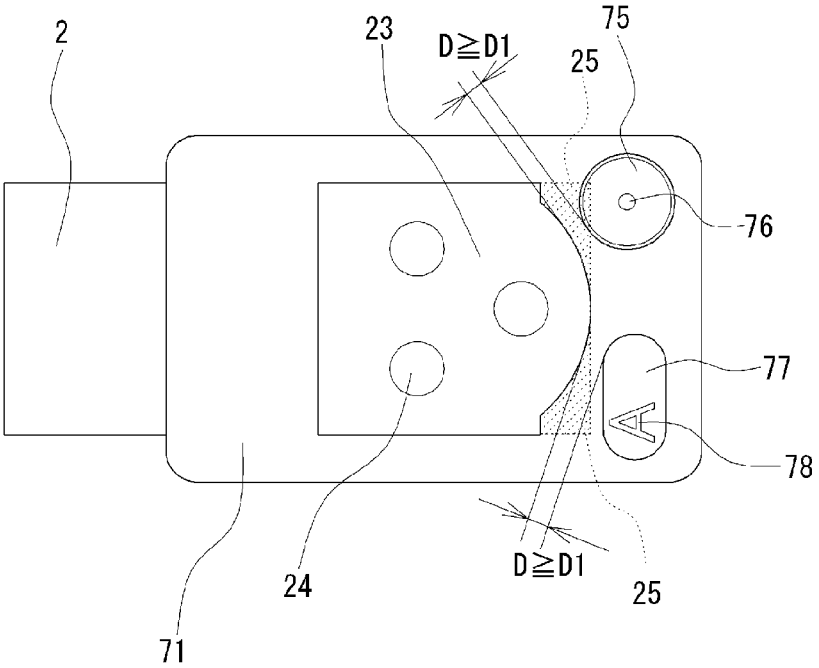
FIG. 5 is a bottom view of a resin case and a fixed piece constituting the breaker.

FIG. 5 shows a bottom view of the case body 71 of the resin case 7 and the fixed piece 2 constituting the breaker 1. The fixed piece 2 has the other end 23 that is exposed to the bottom wall of the case body 71. In the vicinity of corners of the bottom wall of the case body 71, the recessed portions 75, 77 are provided. The recessed portions 75, 77 are depressed from their peripheral portions.

The recessed portion 75 accommodates therein a gate cut mark 76. The gate cut mark 76 represents a mark of the resin material hardened within a gate of the molding die and cut out during demolding or in a subsequent step. The gate cut mark 76 protrudes from a bottom wall of the recessed portion 75 by a slight extent. The recessed portion 75 is set to have a depth that prevents a front end of the gate cut mark 76 from protruding from the bottom wall of the case body 71. Also, the recessed portion 75 may have a diameter that is set depending on a diameter of the gate.

The recessed portion 77 is formed around a convex-shaped engraved mark 78. In FIG. 5, the engraved mark 78, indicating one example with a character string "A", is formed in such a way to protrude from the bottom wall of the recessed portion 77. The character string, indicated by the engraved mark 78, ensures to indicate, for example, a product number and a production lot number of the breaker 1. As with the gate cut mark 76, the depth of the recessed portion 77 and the amount of projection of the engraved mark 78 are set not to cause a front end of the engraved mark 78 from protruding from the bottom wall of the case body 1. Moreover, the recessed portion 77 has a shape and a size that are set depending on the engraved mark 78. Although the embodiment of the engraved mark 78 has been exemplified to be the character string, the recessed portion 77 and the engraved mark 78 may be formed by a code, a graphic, or the like with the same effect being obtained.

Figure 9:
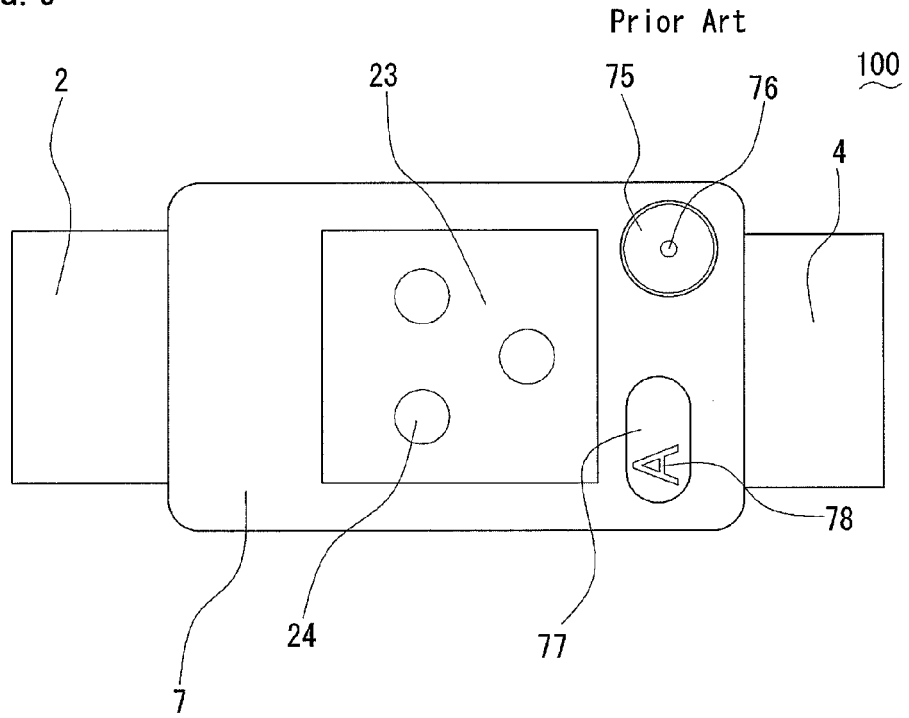
FIG. 9 is a bottom view showing a resin case and a fixed piece forming a related art breaker.

The breaker 1 of the present embodiment differs from that shown in FIG. 9 as viewed from a bottom surface in that it has withdrawal portions 25 indicated by hatched areas in broken lines in FIG. 5. The fixed piece 2 is formed in the rectangular shape as shown in FIG. 9 in consideration of working easiness in a normal state. The rectangular shape is indicated by a broken line as a virtual end edge of the fixed piece 2 in FIG. 5 moreover, the rectangular shape of the fixed piece 2 including the virtual end edge of the fixed piece 2 may be estimated based on a shape, a dimension, a function, or the like that the fixed piece 2 is intended to have with other members such as the PTC thermistor taken into consideration. With the provision of the withdrawal portions 25 withdrawing inward from the virtual end edge of the fixed piece 2, the breaker 1 of the present embodiment takes the form of a structure such that a distance D (each of the respective shortest distances) between the end edge of the fixed piece 2 and the recessed portions 75, 77 of the case body 71 is equal to or longer than a predetermined first distance D1. That is, even if the distance D between the virtual end edge of the fixed piece 2 and the recessed portions 75, 77 of the case body 71 becomes less than the first distance D1, the withdrawal portions 25 withdraw from the recessed portions 75, 77 such that the distance D between the end edge of the fixed piece 2 and the recessed portions 75, 77 of the case body 71 takes a value equal to or longer than the first distance D1. The first distance D1 may be set when taking into consideration the degree of the resin material of the case body 71 flowing through the molding die, the mechanical strength of the case body 71, the withstand voltage of the breaker 1, and temperature characteristics of the breaker 1. The first distance D1 may be set to be equal to or longer than the same level as the minimum wall thickness of a resin portion set for each resin material used in various safety standards such as the UL (Underwriters Laboratories Inc.) standards and the TUV (Technischer Überwachungs Verein) standards. More particularly, the first distance D1 is set to have a value ranging from, for example, 0.1 mm to 0.4 mm. In order to realize the miniaturization of the breaker 1, the first distance D1 may be preferably set to be equal to or less than the upper limit value noted above. In order to suppress the flowing defect of the resin material and to enhance the mechanical strength of the case body 71 and the withstand voltage of the breaker 1, the first distance D1 may be preferably set to be equal to or longer than the lower limit value mentioned above.

Providing the withdrawal portions 25 makes the distance between an actual end edge of the fixed piece 2 and the recessed portions 75, 77 longer than the distance between the virtual end edge of the fixed piece 2 and the recessed portions 75, 77. With the distance between the actual end edge of the fixed piece 2 and the recessed portions 75, 77 being longer than the first distance D1, the distance between the virtual end edge of the fixed piece 2 and the recessed portions 75, 77 may be shorter than the first distance D1. In addition, as shown in FIG. 5, under a circumstance where the withdrawal portions 25 and the recessed portion 75 overlap each other in plan view (in bottom view), the distance between the virtual end edge of the fixed piece 2 and the recessed portions 75, 77 may be treated as a negative value in the distance comparison.

As shown in FIG. 5, the end edge of the fixed piece 2 withdrawn by the withdrawal portions 25 is formed along an end edge of the PTC thermistor 6. In other words, the withdrawal portions 25 are formed such that the end edge of the fixed piece 2 is withdrawn inward from the virtual end edge in plan view along the end edge of the PTC thermistor 6. With the present embodiment, the end edge of the fixed piece 2 withdrawn by the withdrawal portions 25 is formed in a similarity shape in plan view with respect to the end edge of the PTC thermistor 6. As shown in FIGS. 1 and 5, since the frame 73*d*, which is formed on the case body 1, is formed facing to the end edge of the PTC thermistor 6, the end edge of the fixed piece 2 withdrawn by the withdrawal portions 25 is formed along the frame 73*d*, formed in a similarity shape with respect to the frame 73*d* in plan view, and embedded in the resin that is formed into the case body 71 outside the frame 73*d*. Here, the term "similarity shape" means that both shapes approximately match and may be formed in curvatures mutually close to each other such that both contours are not significantly different from each other. The curvatures are not necessarily constant but may partially differ in an area withdrawn by the withdrawal portions 25.

At the withdrawal portions 25, the metallic material of the fixed piece 2 is removed; instead, the resin material that is to be formed into the case body 71 during insert molding of the case body 71 fills the withdrawal portions 25. The withdrawal portions 25 are formed by press working. Since the areas from which the metallic material is removed are filled with the resin material, the case body 71 can be formed at low cost using a molding die similar to that of the related art. The presence of the withdrawal portions 25 enables the distance D between the end edge of the fixed piece 2 and the recessed portions 75, 77 to be equal to or longer than the first distance D1. This prevents the cavity of the molding die in which to form the case body 71 from being locally diminished. As a result, this prevents the filling defect of the resin material between the end edge of the fixed piece 2 and the recessed portions 75, 77 and deterioration of strength of the resin case 7.

Providing the withdrawal portions 25 at the end edge of the fixed piece 2 enlarges the distance D between the end edge of the fixed piece 2 and the recessed portions 75, 77 to be equal to or longer than the first distance D1, while increasing the degree of freedom in layout of the recessed portions 75, 77. This ensures to collectively locate the recessed portions 75, 77 in the vicinity of the joggles 24 of the fixed piece 2, that is, in the vicinity of the PTC thermistor 6. With the present embodiment, in particular, the end edge of the fixed piece 2 withdrawn by the withdrawal portions 25 are formed along the end edge of the PTC thermistor 6. This further ensures to collectively locate the recessed portions 75, 77 in the vicinity of the PTC thermistor 6. This ensures to miniaturize the resin case 7 and, accordingly, the breaker 1.

Further, the end edge of the fixed piece 2 withdrawn by the withdrawal portion 25 is embedded in the resin constituting the case body 71 outside the frame 73*d*. This enables the end edge of the fixed piece 2 to be firmly jointed to the case body 71. Furthermore, the end edge of the fixed piece 2 withdrawn by the withdrawal portion 25 is formed along the frame 73*d* in the similarity shape in plan view. This enables the fixed piece 2 to be uniformly distributed over the area embedded in the case body 71 outside the frame 73*d*. This prevents stress from concentrating on the fixed piece 2 and the case body 71, thereby enabling the breaker 1 to have increased strength. The frame 73*d* is formed facing to the sidewall of the end edge of the PTC thermistor 6, thereby properly sustaining the position and the attitude of the PTC thermistor 6. This stabilizes the contact state between the PTC thermistor 6 and the joggles 24 of the fixed piece 2, thereby enabling the self-holding circuit of the PTC thermistor 6 to effectively function.

Increasing the degree of freedom in layout of the recessed portions 75, 77 to collectively locate the recessed portions 75, 77 in the vicinity of the PTC thermistor 6 elongates the distance D between the portion (particularly the bent portion 46 of the movable piece 4) of the movable piece 4 and the recessed portions 75, 77. This ensures the distance D between the movable piece 4 and the recessed portions 75, 77 to be equal to or longer than a second distance D2 (see FIG. 4). This makes it easy for the breaker 1 to be miniaturized while suppressing the filling defect of the resin material between the movable piece 4 and the recessed portions 75, 77 and deterioration of strength of the resin case 7. As with the first distance D1, the second distance D2 is set in consideration of the degree of flow of the resin material in the molding die in which to form the case body 71, the strength of the case body 71, the withstand voltage of the breaker 1, and various safety standards.

Modified Example

Figure 6:
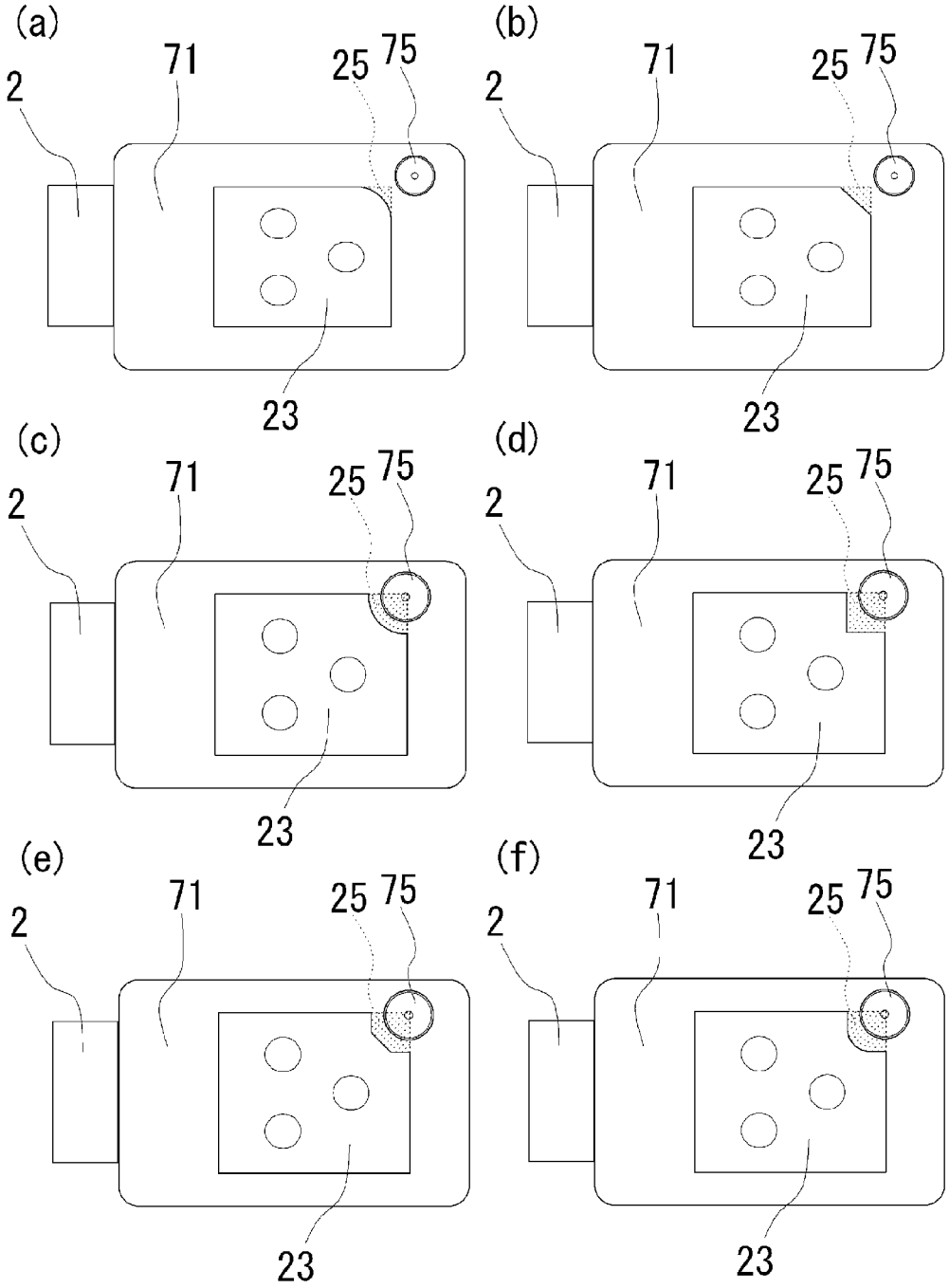
FIG. 6 is a bottom view showing variations of modified examples of the resin case and the fixed piece.

FIG. 6 shows a variety of modified examples of the withdrawal portion 25 and the recessed portion 75. Although the following indicates samples in which the withdrawal is made with respect to the recessed portion 75, this similarly applies to a case where the withdrawal is made with respect to the recessed portion 77. The withdrawal portion 25 may have a shape that is not particularly limited insofar as it has a shape withdrawing from (evading) the recessed portion 75. Such a shape includes a circular-arc shape formed by rounding a corner of the end edge of the fixed piece 2 facing to the recessed portion 75 as shown in FIG. 6(*a*), and a chamfered shape formed by cutting out the corner of the end edge of the fixed piece 2 facing to the recessed portion 75 as shown in FIG. 6(*b*). Another shape may include a shape formed in a similarity shape by cutting out the corner of the end edge of the fixed piece 2 along an external edge of the recessed portion 75 as shown in FIG. 6(*c*), and a rectangular shape formed by cutting out the corner of the end edge of the fixed piece 2 facing to the recessed portion 75 as shown in FIG. 6(*d*). Still another shape may include a shape having a corner portion cut out in a rectangular shape and buried in a reverse chamfered shape as shown in FIG. 6(*e*), and a shape having a corner portion cut out in a rectangular shape and rounded as shown in FIG. 6(*f*). Such a chamfered or a rounded shape may include those which are chamfered or rounded in shape in a larger size than an extent that is required for processing other normal corners such as the corner of the terminal 22 of the fixed piece 2 and the corner of the terminal 41 of the movable piece 4, or which are formed in a remarkably larger size than an extent for processing against a normal corner with no withdrawal portion 25 provided.

Modified Example

Figure 7:
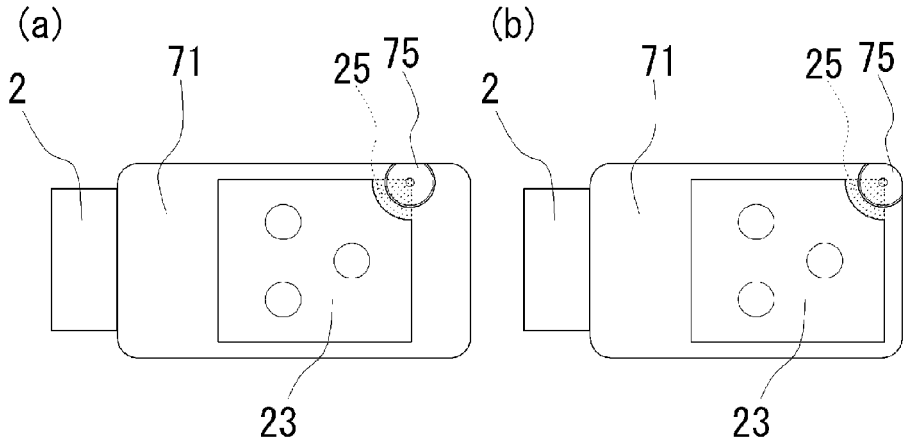
FIG. 7 is a bottom view showing variations of the other modified examples of the resin case and the fixed piece.

FIG. 7 shows other various modified examples of the withdrawal portion 25 and the recessed portion 75. The recessed portion 75 may have a shape that reaches one side of the end edge of the case body 71 as shown in FIG. 7(*a*), and the recessed portion 75 may have a shape that reaches two sides of the end edge of the case body 71 as shown in FIG. 7(*b*).

Modified Example

Figure 8:
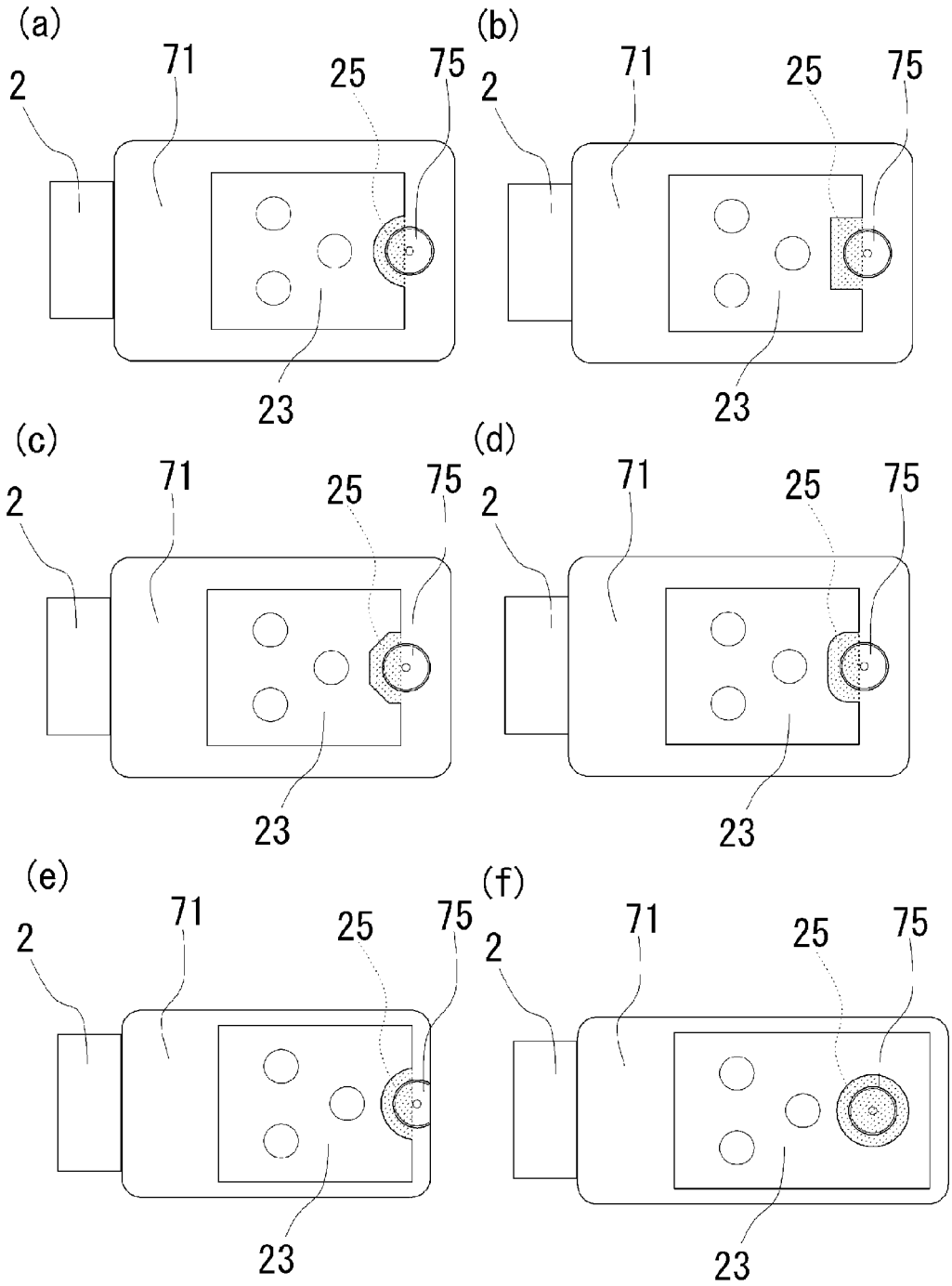
FIG. 8 is a bottom view showing variations of further modified examples of the resin case and the fixed piece.

FIG. 8 shows further various modified examples of the withdrawal portion 25 and the recessed portion 75. The modified examples may include a shape as shown in FIG. 8(*a*), in which one side of the fixed piece 2 is cut out in a similarity shape along an external edge of the recessed portion 75, and another shape as shown in FIG. 8(*b*), in which one side of the end edge of the fixed piece 2 is cut out in a rectangular configuration facing to the recessed portion 75. The modified examples may further include a shape as shown in FIG. 8(*c*), in which a corner portion cut out in a rectangular shape is buried in a reversely chamfered portion, and another shape as shown in FIG. 8(*d*), in which a corner portion cut out in a rectangular shape is rounded. The modified examples may further include a shape as shown in FIG. 8(*e*), in which the recessed portion 75 reaches the end edge of the case body 71. In addition, as shown in FIG. 8(*f*), the withdrawal portion 25 is not formed at the outer edge of the fixed piece 2 but formed in an internal area.

Thus, the shape of the withdrawal portion 25 is not limited to the shape based on the circle or the rectangle insofar as the withdrawal portion 25 is spaced from the recessed portions 75, 77 by a distance equal to or longer than the first distance D1. For example, the withdrawal portion 25 may take a shape based on a polygon or arbitrary curves such as an ellipse and a parabola.

Further, the positions of the recessed portions 75, 77 are not particularly limited provided that the recessed portions 75, 77 are placed in the vicinity (the vicinity of the end edge of the fixed piece 2 at which the withdrawal portion 25 is provided) of an area in which the gate cut mark 6 and the fixed piece 2 are close to each other with the intervening withdrawal portion 25 and that the withdrawal portion 25 and the recessed portions 75, 77 are spaced from each other by the first distance D1 so that the breaker 1 is miniaturized. For example, although FIG. 5 exemplifies the embodiment in which the recessed portion 75 and the recessed portion 77 (punch mark 78) are unevenly distributed in the vicinity of one side (on a side of the end edge from which the terminal 41 of the movable piece 4 protrudes) of the end edge of the case body 71, the recessed portion 75 and the recessed portion 77 may be provided in the vicinity of respective other sides. Moreover, a modification may include an embodiment in which the recessed portion 75 and the recessed portion 77 are unevenly distributed in the vicinity of another side (on a side of the end edge from which the terminal 22 of the fixed piece 2 protrudes or on a side intersecting the same) to be different from the exemplified embodiment. Also, the recessed portion 75 and the recessed portion 77 may be dispersed in the vicinities of the respective sides. In consideration of an increase in strength and rigidity of the breaker 1, it may be more preferable to take a simplified form in which the recessed portions 75, 77 are provided in positions that do not reach the side of the end edge of the case body 71, that is, a circumferential periphery of the end edge of the case body 71 is closed where the case body 71 has sidewalls which are not opened by the recessed portions 75, 77. In particular, even under circumstances where a multi-cavity molding die is applied enabling a large number of case bodies 71 to be mold at one time, a simplified mode may be preferably employed in which, in consideration of working easiness of such a molding die, the recessed portions 75, 77 are provided in positions in which the sidewalls or the bottom wall of the recessed portions 75, 77 do not reach the end edge of the case body 71. In addition, for miniaturizing the breaker 1, it may be preferred that the end edge of the fixed piece 2 and the recessed portions 75, 77 of the case body 71 are made closer to each other to the extent in which the withdrawal portion 25 and the recessed portions 75, 77 overlap each other at the bottom surface.

As set forth above, with the breaker 1 of the present embodiment, the fixed piece 2 is provided with the withdrawal portions 25 such that the fixed piece 2, buried in the case body 71 of the resin case 7, withdraws from the recessed portions 75, 77 of the case body 71. This increases the degree of freedom in positions, shapes, and size of the recessed portions 75, 77 without causing the filling defect of the resin material between the fixed piece 2 and the recessed portions 75, 77 and deterioration of strength of the resin case 7. This realizes the miniaturization of the breaker 1.

In particular, the presence of the withdrawal portions 25 withdrawing from the recessed portion of the case body 71 by equal to or longer than the first distance D1 enables a further suppression of the filling defect of the resin material and deterioration of strength of the resin case.

Providing the recessed portions 75, 77 in the positions spaced from the movable piece 4 by equal to or longer than the second distance D2 further realizes the miniaturization of the breaker 1 without causing the filling defect of the resin material between the fixed piece 2 and the recessed portions 75, 77 and deterioration of strength of the resin case 7.

Further, the recessed portion 75 accommodates the gate cut mark 76 with an increase in the degree of freedom in layout of the gate in the molding die. This realizes the miniaturization of the breaker 1 while suppressing the filling defect of the resin material. Furthermore, the recessed portion 77 is provided around the convex-shaped engraved mark 78 formed on a surface of a product. This realizes the miniaturization of the breaker 1 while increasing the degree of freedom in layout of the engraved mark 78 and suppressing the filling defect of the resin material. Moreover, the engraved mark 78, if suitably selected, becomes a tracking index for identifying the molding die and the cavity used for manufacturing respective solids of the breaker 1. This is useful for quality management.

With the embodiment in which the withdrawal portions 25 are formed along the outer edges of the recessed portions 75, 77, it becomes possible to further increase the degree of freedom in position, shape, and size of the recessed portions 75, 77. This further realizes the miniaturization of the breaker 1 while achieving the improvement in space efficiency of the resin case 7. Moreover, this can sufficiently increase the first distance D1 and the second distance D2, thereby making it possible to maintain the mechanical strength of the resin case 7 even if the breaker 1 is miniaturized.

Further, the present invention is not limited the structure of the embodiment set forth above, and at least the resin case 7 of the breaker may suffice to have the recessed portion depressed from a circumferential area with the fixed piece 2 embedded in the resin case 7 such that the withdrawal portion 25 withdraws from the recessed portion of the resin case 7 by equal to or longer than the first distance D1. In such a case, the embodiment of the recessed portion may not be limited to the recessed portion 75 for accommodating the gate cut mark 76 and the recessed portion 77 provided around the engraved mark 78. For example, the embodiment of the recessed portion includes all portions depressed from the circumferential areas, such as a convex-shaped engraved mark formed on the surface of the product. In addition, the resin case 7 may preferably include not only the case body 71 but also an embodiment in which the lid member 72 is provided with the recessed portion 75, 77 or an embodiment in which the fixed piece 2 is embedded.

Further, the present invention may be implemented in various modifications. For example, the movable piece 4 is formed of a stacked metal such as bimetal and trimetal, and the movable piece 4 and the thermally responsive element 5 are integrally formed. In such a case, the breaker 1 can be simplified in structure, achieving further miniaturization and reduced wall thickness.

Furthermore, the movable piece 4 may not be limited to the embodiment having the stepped bent portion 46 and may include an embodiment in which the resilient portion 43 and the terminal 41 are formed in a flat shape.

The fixed piece 2 withdrawn by the withdrawal portion 25 may suffice to have an end edge that, in a general shape, is formed along the FTC thermistor 6 and the frame 73*d* in a similarity shape in plan view in correspondence to the PTC thermistor 6 and the frame 73*d*. The fixed piece 2 may preferably have an end edge in shape that departs from shapes corresponding to the PTC thermistor 6 and the frame 73*d*. For example, the handling on the similarity shape may be incomplete in part in the presence of a small protuberance or a cutout to insofar as no filling defect occurs for the resin material to be formed into the case body 7 and no unfavorable clearance occurs created between the case body 71 and the fixed piece 2.

Further, although with the present embodiment the PTC thermistor 6 includes a self-holding circuit, such a structure may be omitted in structure. Even in such a case, providing the withdrawal portion 25 in the end edge of the fixed piece 2 results in an increase in the degree of freedom in layout of the recessed portions 75, 77, realizing the miniaturization of the breaker 1. Furthermore, the movable piece 4 may be formed of bimetal, trimetal, or the like such that the movable piece 4 and the thermally responsive element 5 are formed in an integrated structure. In this case, the breaker is simplified in structure, achieving further miniaturization.

Moreover, the present invention may be applied to a structure in which, as disclosed in Japanese unexamined Patent Application Publication No. 2005-203277, a fixed piece 42 and its associated vicinity are separated into a side for a terminal 41 and another side for a movable contact 3. In such application, it may suffice for the distance between the recessed portions 75, 77 and an arm terminal 6 disclosed in the patent document to be equal to or longer than the second distance D2.

In addition, the present invention may be applied to an embodiment, as disclosed in Japanese unexamined Patent Application Publication No. 2006-331705, which has two contacts (a first external connection terminal 123-1 and a second external connection terminal 123-2 in the same patent document). In such application, it may suffice for the withdrawal portion 25 to be formed such that the distances between the recessed portions 75, 77 and the first external connection terminal 123-1 and the second external connection terminal 123-2 in the same patent document to be equal to or longer than the first distance D1.

Figure 10:
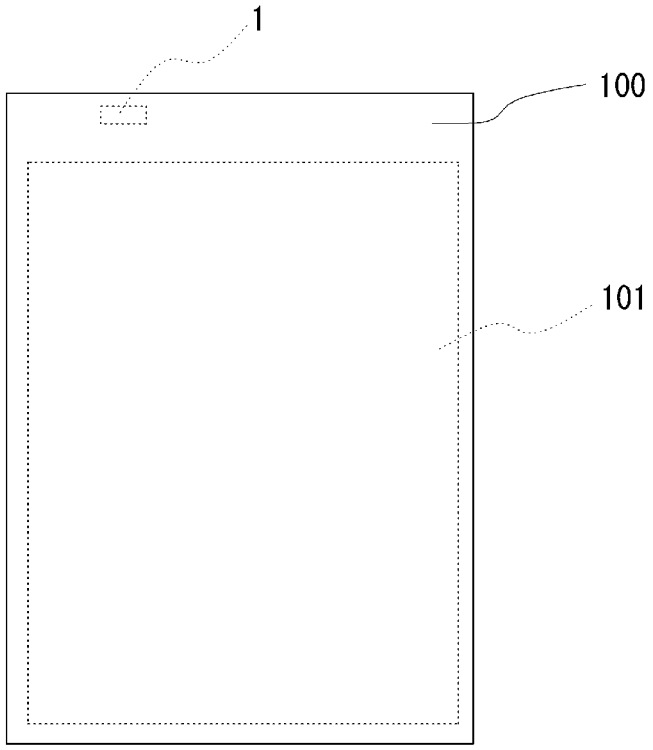
FIG. 10 is a plan view showing a structure of a secondary battery pack equipped with a breaker.
Figure 11:
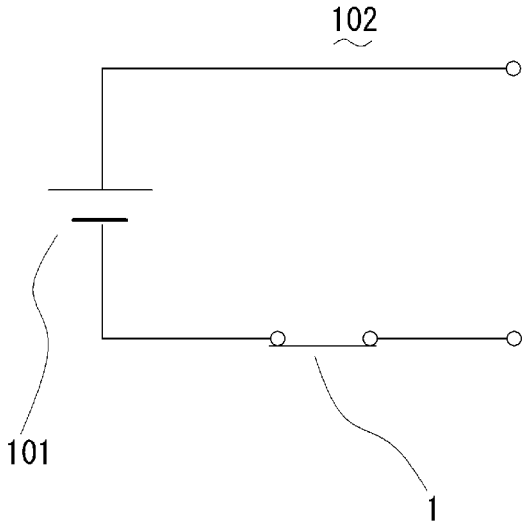
FIG. 11 is a circuit diagram of a safety circuit equipped with a breaker.

Further, the breaker 1 of the present invention may be widely applied to a safety circuit or the like for a secondary battery package and electrical machines. FIG. 10 shows a secondary battery package 100. The secondary battery package 100 includes a secondary battery 101 and the breaker 1 provided in an output terminal circuit of the secondary battery 101. FIG. 11 shows a safety circuit 102 of electrical machines. The safety circuit 102 includes the breaker 1 connected in series with an output circuit of the secondary battery 101.

As set forth above, the present invention may include a breaker including: a fixed piece having a fixed contact; movable piece having a front end provided with a movable contact and causing the movable contact to be brought into contact with the fixed contact; a thermally responsive element deforming due to a change in temperature to actuate the movable contact so as to move the movable contact away from the fixed contact; and a resin case accommodating the fixed contact, the movable contact, and the thermally responsive element. In such a breaker, the resin case may suffice to have the recessed portions depressed from the circumferential areas, and the fixed piece may suffice to have the withdrawal portions withdrawing from the recessed portions of the resin case and embedded in the resin case.

With such a breaker, the withdrawal portions are provided in the fixed piece such that the fixed piece embedded in the resin case withdraws from the recessed portions. This enables an increase in the degree of freedom in position, shape, and size of the recessed portions without causing the filling defect of the resin material between the fixed piece and the recessed portion and without causing deterioration of strength of the resin case. This realizes the miniaturization of the breaker.

The breaker may further include a positive characteristic thermistor configured to enable the movable piece and the fixed piece to be electrically connected by the thermally responsive element when the movable contact is spaced away from the fixed contact. The end edge of the fixed piece withdrawn by the withdrawal portions may suffice to be formed along the end edge of the positive characteristic thermistor.

This breaker ensures to allow the recessed portions to be further collectively located in the vicinity of the positive characteristic thermistor. This enables the resin case and, accordingly, the breaker to be miniaturized.

With such a breaker, the resin case has an accommodating portion for accommodating the positive characteristic thermistor, and the accommodating portion has a frame placed facing to a sidewall of the end edge of the positive characteristic thermistor. The end edge of the fixed piece withdrawn by the withdrawal portions may be formed along the frame.

With such a breaker, the fixed piece may have a region buried in the resin case outside the frame, which can be uniformly distributed. This ensures to avoid a stress from concentrating on the fixed piece and the resin case, enabling an increase in strength of the breaker.

With such a breaker, the withdrawal portion may be withdrawn from the recessed portion of the resin case to be spaced apart at the first distance or longer.

With the embodiment in which the withdrawal portion withdraws from the recessed portion of the resin case at the first distance or longer, it becomes possible to further suppress the filling defect of the resin material and deterioration of strength of the resin case.

With such a breaker, the recessed portion may be provided in a position spaced apart from the movable piece at the second distance or longer.

With the embodiment in which the recessed portion is provided in a position spaced apart from the movable piece at the second distance or longer, the miniaturization of the breaker can be realized without causing the filling defect of the resin material between the movable piece and the recessed portions and deterioration of strength of the resin case.

With such a breaker, the recessed portion may accommodate the gate cut mark.

With the embodiment in which the recessed portion accommodates the gate cut mark, it becomes possible to increase the degree of freedom in layout of the gate in the molding die for molding the resin case and realize the miniaturization of the breaker while suppressing the filling defect of the resin material.

With such a breaker, the recessed portion may include a recessed portion provided around a concave-shaped engraved mark formed on a surface of a product or a concave-shaped engraved mark formed on the surface of the product.

With the embodiment in which the recessed portion includes the engraved mark formed on the surface of the product, it becomes possible to increase the degree of freedom in layout of the engraved mark and to realize the miniaturization of the breaker while suppressing the filling defect of the resin material. In addition, this similarly applies to the embodiment in which the recessed portion is provided around the engraved mark formed on the surface of the product.

With such a breaker, the withdrawal portion may take the form of a shape extending along an outer edge of the recessed portion.

With the embodiment in which the withdrawal portion takes the form of the shape extending along the outer edge of the recessed portion, it becomes possible to further increase the degree of freedom in position, shape, and size of the recessed portion, thereby realizing the miniaturization of the breaker while achieving improvement in space efficiency of the resin case.

Further, the present invention is a safety circuit for an electric machine characterized by the provision of the breaker.

Furthermore, the present invention is a secondary battery characterized by the provision of the breaker.

DESCRIPTION OF THE REFERENCE NUMERAL

1 Breaker
2 Fixed Piece
3 Movable Contact
4 Movable Piece
5 Thermally responsive element
7 Resin Case

8 Cover Piece
21 Fixed Contact
25 Withdrawal Portions
71 Case Body
73 Accommodating Portions
73*d* Frame
75 Recessed Portion
76 Gate cut mark
77 Recessed Portion
78 Engraved mark
101 Secondary Battery
102 Safety Circuit

The invention claimed is:

1. A breaker comprising:

a fixed piece having a fixed contact;

a movable piece having a movable contact at a front end portion and causing the movable contact to be held in pressured contact with the fixed contact;

a thermally responsive element actuating the movable piece upon deformation in response to a change in temperature such that the movable contact is separated away from the fixed contact;

a positive characteristic thermistor enabling the movable piece and the fixed piece to be electrically connected via the thermally responsive element when the movable contact is separated from the fixed contact; and a resin case accommodating the fixed piece, the movable piece, and the thermally responsive element, wherein the resin case comprises a recessed portion depressed from a peripheral portion on an outer bottom surface, and wherein the fixed piece comprises a withdrawal portion withdrawing from the recessed portion of the resin case in a longer side direction of the resin case and a shorter side direction of the resin case in a bottom view and embedded in the resin case; and wherein the withdrawal portion has an end edge formed into a circular-arc shape along an end edge of the positive characteristic thermistor and located closest to the recessed portion, and an area between the recessed portion and the end edge of the withdrawal portion is filled with resin material of the resin case.

2. The breaker according to claim 1, wherein the resin case comprises an accommodating portion accommodating the positive characteristic thermistor, wherein the accommodating portion has a frame facing to a sidewall of an end edge of the positive characteristic thermistor, and wherein the end edge of the withdrawal portion is formed along the frame in a bottom view of the resin case.

3. The breaker according to claim 1, wherein the withdrawal portion is withdrawn from the recessed portion of the resin case at a first distance or longer.

4. The breaker according to claim 1, wherein the withdrawal portion is provided in a position spaced apart from the movable piece at a second distance or longer.

5. The breaker according to claim 1, wherein the recessed portion accommodates a gate cut mark.

6. The breaker according to claim 1, wherein the recessed portion is provided around a convex-shaped engraved mark formed on the surface of the breaker.

7. The breaker according to claim 1, wherein the withdrawal portion comprises a shape extending along an outer edge of the recessed portion.

8. A safety circuit comprising a breaker according to claim 1.

9. A secondary battery comprising a breaker according to claim 1.

10. The breaker according to claim 2, wherein the withdrawal portion is withdrawn from the recessed portion of the resin case at a first distance or longer.

11. The breaker according to claim 2, wherein the withdrawal portion is provided in a position spaced apart from the movable piece at a second distance or longer.

12. The breaker according to claim 3, wherein the withdrawal portion is provided in a position spaced apart from the movable piece at a second distance or longer.

13. The breaker according to claim 2, wherein the recessed portion accommodates a gate cut mark.

14. The breaker according to claim 3, wherein the recessed portion accommodates a gate cut mark.

15. The breaker according to claim 4, wherein the recessed portion accommodates a gate cut mark.

* * * * *